US007118407B2

(12) United States Patent
Ching

(10) Patent No.: US 7,118,407 B2
(45) Date of Patent: Oct. 10, 2006

(54) POWER PLUG WITH OVERLOADED DISPLAY

(75) Inventor: Chan Ching, Taipei Hsien (TW)

(73) Assignee: Perfect Union Co. Ltd., Taipei Hsien (TW)

( * ) Notice: Subject to any disclaimer, the term of this patent is extended or adjusted under 35 U.S.C. 154(b) by 0 days.

(21) Appl. No.: 10/815,815

(22) Filed: Apr. 2, 2004

(65) Prior Publication Data

US 2005/0221674 A1 Oct. 6, 2005

(30) Foreign Application Priority Data

Mar. 10, 2004 (TW) ..... 093203633

(51) Int. Cl.
*H01R 3/00* (2006.01)

(52) U.S. Cl. ..... 439/488; 439/911

(58) Field of Classification Search ..... 439/488, 439/620, 622, 911
See application file for complete search history.

(56) References Cited

U.S. PATENT DOCUMENTS 4,400,412 A * 8/1983 Scanlon et al. ..... 65/60.52
5,188,542 A * 2/1993 Ballman ..... 439/620
5,922,996 A * 7/1999 Ryeczek ..... 174/112

* cited by examiner

*Primary Examiner*—Javaid H. Nasri
(74) *Attorney, Agent, or Firm*—Troxell Law Office, PLLC

(57) ABSTRACT

A power plug with overloaded display providing users with a function of a warning display for protecting the power plug from over-heated melting and from shorting and catching on fire. The plug includes an embedded positioned block arranged on a periphery of electric metal-pins of the power plug, and a thermochromic film is coated on the surface of the embedded positioned block, and warning characters are printed on the embedded positioned block. The external body of the power plug is made by injection modeling with mixed transparent PVC and thermochromic materials, or the embedded positioned block may be directly injected with thermochromic materials, or connected with a detecting transistor linked by a light emitting diode (LED). When the power plug is over-heated and the temperature of the power plug generally increases, the thermochromic materials or the LED will display a warning message.

7 Claims, 2 Drawing Sheets

POWER PLUG WITH OVERLOADED DISPLAY

BACKGROUND OF THE INVENTION

Generally, electric equipment using alternating current usually is plugged into an alternating current plug by a power plug through wires. As we know, alternating current power source generally is divided into 2 types, 110 voltage and 220 voltage. At present, the most common structure applied for power plug comprises 2 or 3 electric metal-pins (hot, neutral, and ground), wherein one end of the electric metal-pins is connected with the copper core of wires, after connecting, the back section of the electric metal-pins and a predetermined length of wire are molded or injection modeled with PVC to form an external body of the power plug, and the external body is suitable for being held by hand. The external body comprises a flexible rear fin, and enables the front section of the electric metal-pins exposed outside the power plug to contact the electric metal-sheet for conducting electricity, in this way, a power plug made of PVC is completed.

As we know, the electric metal-pin of a power plug generally is the easiest part to accumulate heat when using, especially the part between electric metal-pins and core of the wires usually is the key place for shorts and fires. If the equipment is overloaded, the temperature will increase.

Therefore, the PVC of the conventional used power plug, which contacts the electric metal-pins, will be hardened after a period time of using because of heat, resulting in the position changing between the two electric metal-pins or deforming the power plug. When in an abnormal overload condition and the temperature in electric metal-pins is increasing, if users do not shut down the power in time and check the equipment, which will melt the PVC and result in high temperature sparks. These conditions will make electric wires or equipment catch fire more easily, even resulting in fire accidents.

Then, if the conventional power plug can display a warning function when abnormal temperature increases, accidents will be avoided at an early stage.

SUMMARY OF THE INVENTION

A power plug with overloaded display, which provides users with the function of warning display for protecting the power plug from over-heated melting, wherein an embedded positioned block is arranged on the periphery of the electric metal-pin of said power plug, and a thermochromic film is coated on the surface of said embedded positioned block, and warning characters are printed on said embedded positioned block. The external body of said power plug is made by injection modeling with mixed transparent PVC and thermochromic materials, or the embedded positioned block may be directly injected with thermochromic materials, or connected with a detecting transistor linked by a light emitting diode( LED). The appearance of the power plug is formed like a plug by being injected with transparent PVC. When the power plug is over-heated and the temperature of the power plug gradually increases, the thermochromic film will change its color to warn users or the LED will flash to protect the power plug from over-heated melting or from shorting and catching on fire.

DETAILED DESCRIPTION OF THE INVENTION

Figure 1:
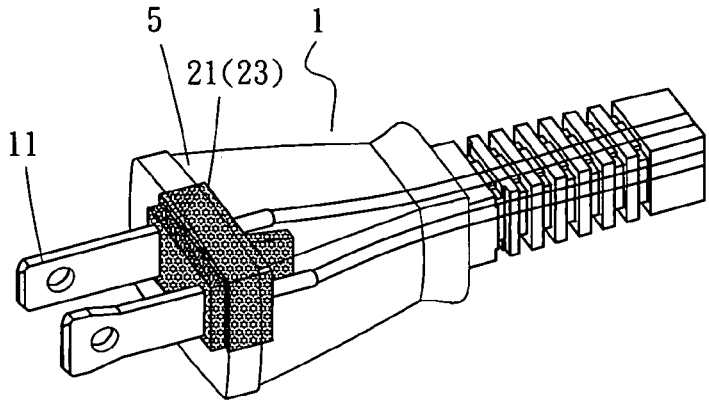
FIG. 1 is a three-dimensional view showing the power plug with overloaded display of the present invention.

The power plug with overloaded display of the present invention is as shown in FIG. 1. The present invention relates to embedding an orientated block (2) on the periphery of the electric metal-pins (11) of a power plug (1), wherein the embedded positioned block (2) is made of fire-resistant, and high intensity materials insulated against electricity and heat, and arranged with positioned metal-pins (11), such as PBT (Polybutylene Terephthalate) . . . etc. The embedded positioned block (2) may be coated with thermochromic film (21), or be formed by directly injected with thermochromic materials (23), and the appearance of the external body (5) of the power plug is formed like a plug by injection modeling with transparent PVC.

As above mentioned, when the power plug is overloaded and the temperature of it increases under use, users can be noted or warned that the power plug is under unusual temperature increasing condition by the color change of the thermochromic film (21), or by the color change of the embedded positioned block (23) containing thermochromic materials, for security control such as shutting down the power immediately . . . etc, which protects the power plug from over-heated melting or form shorting and catching on fire.

Figure 2:
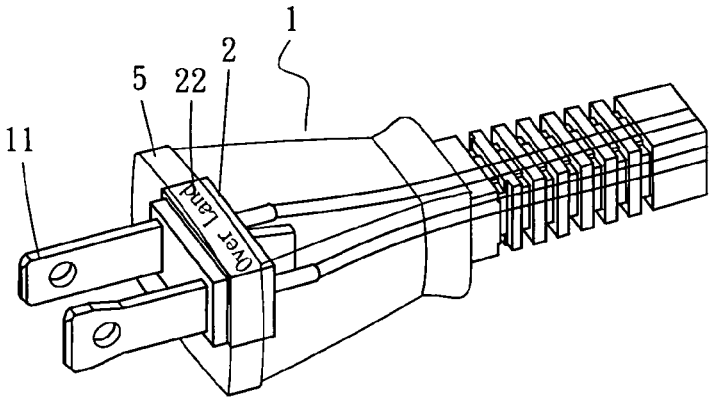
FIG. 2 is a three-dimensional view showing the power plug with overloaded display, which is made of thermochromic materials and printed with warning characters of the present invention.

As shown in FIG. 2, the surface of the above mentioned embedded positioned block (2) may also be printed with warning characters (22) (such as overload, or danger) containing thermochromic materials, wherein the warning characters will change its color when the power plug is overloaded and its temperature increases. In this way, users also can be noted or warned that the power plug's temperature is unusually increasing.

Figure 3:
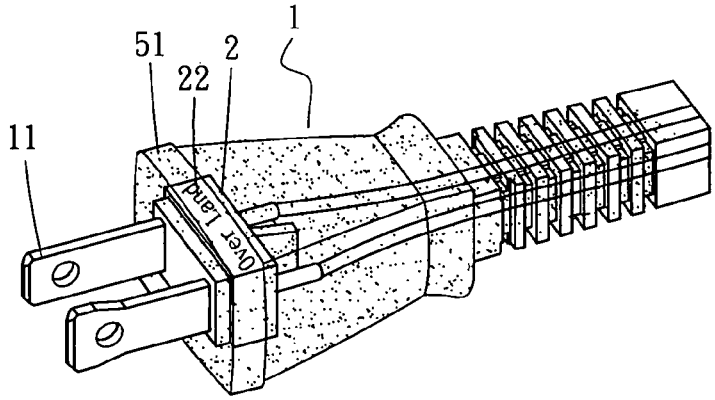
FIG. 3 is a three-dimensional view showing the power plug made by injection modeling with mixed thermochromic materials and PVC.

As shown in FIG. 3, the external body (51) of the power plug of the present invention may also be injection modeled with mixed thermochromic materials and PVC to change its color to warn users when the power plug is overloaded and the temperature is increasing.

Figure 4:
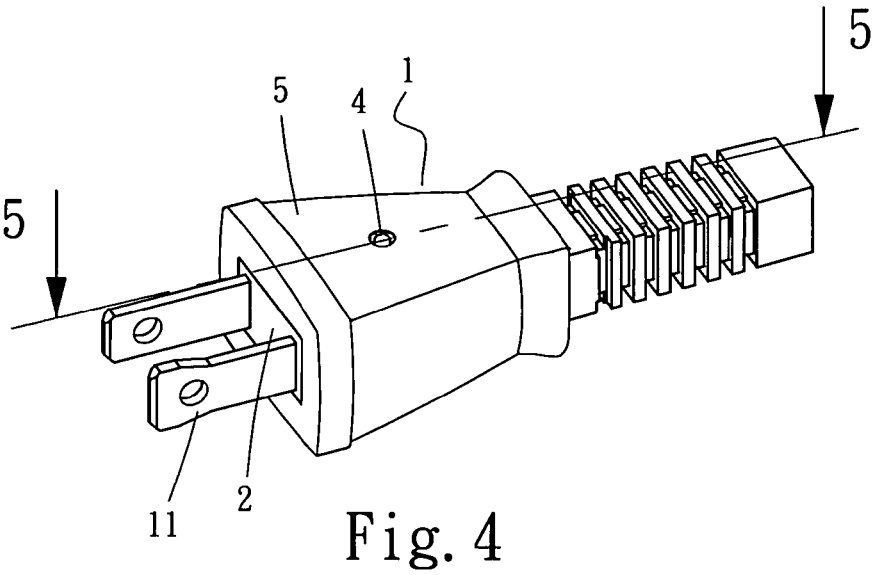
FIG. 4 is the perspective view showing the power plug with overloaded display and arranged with a detecting transistor of the present invention.
Figure 5:
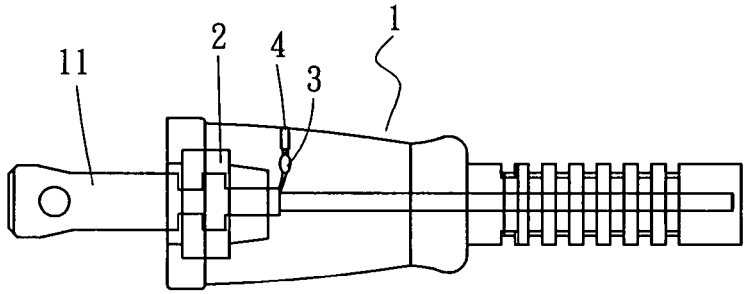
FIG. 5 is the perspective view of FIG. 3 of the present invention.
Figure 6:
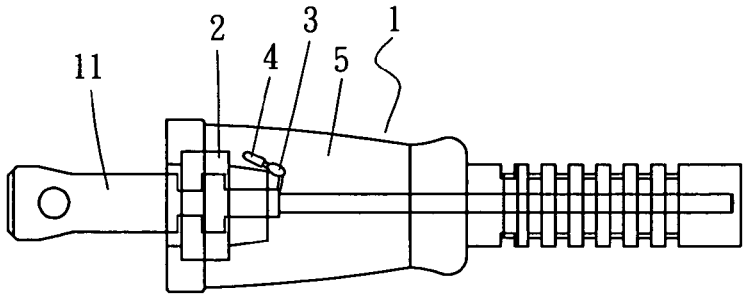
FIG. 6 is the cross-section view for another example of FIG. 3 of the present invention.

With the above mentioned methods for warning, as shown in FIG. 4 and FIG. 5, the present invention furthermore may comprise a detecting transistor (3) arranged on the power plug, and connect with a light emitting diode (LED, 4). The top of the LED is exposed outside the surface of the external body (5) of the power plug (which makes the materials for the injected external body (5) not only limited in transparent materials), or as shown in FIG. 6, the LED (4) is arranged with the external body (5) of the power plug injection modeled with transparent PVC materials. Hence, when the detecting transistor (3) detects that power plug (1) is overloaded, the LED (4) will be flashed to note or warn users that the temperature of the power plug is in abnormal increasing condition, to protect the power plug from over-heated melting or from shorting and catching on fire.

What is claimed is:

1. A power plug with an overload display comprising:

a) a plurality of metal pins;

b) an embedded block directly located around a periphery of an end of the plurality of metal pins and having a thermochromic portion indicating an overload condition of the power plug; and c) a transparent housing covering a predetermined portion of each of the plurality of metal pins and the embedded block, wherein, when the power plug is in the overload condition, the thermochromic portion is visible from an exterior of the housing.

2. The power plug according to claim 1, wherein the thermochromic portion of the embedded block includes thermochromic materials integrally formed therein.

3. The power plug according to claim 1, wherein the thermochromic portion of the embedded block is a thermochromic film located on an outer periphery of the embedded block.

4. The power plug according to claim 1, wherein the thermochromic portion of the embedded block is warning characters printed with thermochromic materials on an outer periphery of the embedded block.

5. The power plug according to claim 1, wherein the housing includes thermochromic materials integrally formed therein.

6. The power plug according to claim 1, further comprising a light emitting diode located in the housing and a detecting transistor controlling the light emitting diode, wherein the light emitting diode emitting a light when the power plug is in the overload condition.

7. The power plug according to claim 1, wherein the thermochromic portion is made of Polybutylene Terephthalate.

* * * * *